US009285702B2

(12) United States Patent
Nakagawa

(10) Patent No.: US 9,285,702 B2
(45) Date of Patent: Mar. 15, 2016

(54) IMAGE FORMING APPARATUS AND IMAGE FORMING METHOD

(71) Applicant: KYOCERA Document Solutions Inc., Osaka (JP)

(72) Inventor: Tatsuya Nakagawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/283,171

(22) Filed: May 20, 2014

(65) Prior Publication Data

US 2015/0338762 A1 Nov. 26, 2015

(30) Foreign Application Priority Data

May 29, 2013 (JP) ..... 2013-112880
May 29, 2013 (JP) ..... 2013-112881

(51) Int. Cl.
*G03G 15/06* (2006.01)
*G03G 15/043* (2006.01)
*G03G 15/00* (2006.01)

(52) U.S. Cl.
CPC ..... *G03G 15/043* (2013.01); *G03G 15/5041* (2013.01); *G03G 15/065* (2013.01)

(58) Field of Classification Search
CPC ..... G03G 15/5041
See application file for complete search history.

(56) References Cited

U.S. PATENT DOCUMENTS 5,724,627 A * 3/1998 Okuno et al. ..... 399/27
6,750,892 B2 * 6/2004 Suzuki ..... 347/133
6,889,017 B2 * 5/2005 Park et al. ..... 399/55
7,298,391 B2 * 11/2007 Emmert et al. ..... 347/251
7,512,350 B2 * 3/2009 Itagaki ..... 399/49
8,107,841 B2 1/2012 Tamaoki ..... 399/56
2011/0206394 A1 8/2011 Takenaka ..... 399/46

FOREIGN PATENT DOCUMENTS

JP H8-286475 A 11/1996
JP 2005-316073 A 11/2005
JP 2007-53613 A 3/2007
JP 2009-300932 A 12/2009
JP 2011-170156 A 9/2011

OTHER PUBLICATIONS

Japanese Office Action dated Aug. 7, 2015, issued to Japanese Application No. 2013-112881.
Japanese Office Action dated Aug. 7, 2015, issued to Japanese Application No. 2013-112880.

* cited by examiner

*Primary Examiner* — Clayton E Laballe
*Assistant Examiner* — Leon W Rhodes, Jr.
(74) *Attorney, Agent, or Firm* — Stein IP, LLC

(57) ABSTRACT

In the image forming apparatus, the space detecting unit detects the space between the image carrying surface and the developer carrying surface. The correcting unit corrects the intensity of the development field for developing the electrostatic latent image on the image carrying surface based on the acquired correspondence relation and the space detected by the space detecting unit, for example. In this case, the correspondence relation is a relation between the image density of the visible image transferred from the image carrying surface to the transferred medium and the development filed for suppressing the density unevenness of the visible image.

8 Claims, 6 Drawing Sheets

IMAGE FORMING APPARATUS AND IMAGE FORMING METHOD

INCORPORATION BY REFERENCE

This application claims the benefit of Japanese Patent Application No. 2013-112880, filed on May 29, 2013 and Japanese Patent application No. 2013-112881, filed on May 29, 2013, all of which are hereby incorporated by reference in their entireties.

BACKGROUND OF THE INVENTION

The present disclosure relates to an image forming apparatus and an image forming method for forming an electrophotographic image.

The electrophotographic image forming apparatus such as the printer or the copying machine forms an image by performing a series of steps including the charging step, the exposure step, the developing step, the transferring step, and the fixing step. The charging step is for uniformly electrifying a photosensitive drum. The exposing is for exposing an electrified photosensitive drum and forming an electrostatic latent image thereon. The developing is for adhering toners to the electrostatic latent image and forms a visible image. The transferring is for transferring the visible image to a paper. The fixing is for fusing and fixing the visible image transferred to the paper.

In this kind of image forming apparatus, the electrostatic latent image is formed on an image carrying surface of the photosensitive drum, and a developing roller for developing the electrostatic latent image is disposed so as to face the image carrying surface. A surface of the developing roller carries the toner that is the developer. At developing the electrostatic latent image, the development field is generated between the developer carrying surface of the developing roller and the image carrying surface of the photosensitive drum, and the toner is adhered to the electrostatic latent image by the action of the development field.

In order not to change a distance between the image carrying surface and the developer carrying surface facing each other because of the rotation of the photosensitive drum and the rotation of the developing roller, a rotatory shaft of the photosensitive drum is disposed so as to be parallel to a rotatory shaft of the developing roller. In the image forming apparatus assembled in fact, however, the rotatory shaft of the photosensitive drum and the rotatory shaft of the developing roller are disposed within a specific tolerance. That is to say, strictly speaking, there is a possibility that following states appear in the main scanning direction of the photosensitive drum after the assembly; e.g. the rotatory shaft of the photosensitive drum is close to the rotatory shaft of the developing roller at one end, while the rotatory shaft of the photosensitive drum is apart from the rotatory shaft of the developing roller at the other end.

When a constant potential difference is applied between the image carrying surface and the developer carrying surface in order to generate the development field, the intensity of the development field becomes small at a position where the distance between the image carrying surface and the developer carrying surface is large, on that the density of the visible image becomes thin. In addition, the intensity of the development field becomes large at a position where the distance between the image carrying surface and the developer carrying surface is small, so that the density of the visible image becomes dense. That is to say, in the main scanning direction, if the distance between the rotatory shaft the photosensitive drum and the rotatory shaft of the developing roller varies according to a position, it occurs that there is a difference in the amount of toner to be adhered according to the position in the main scanning direction. The variation of the toner adhering amount appears as the density unevenness of the visible image, which deteriorates the picture quality. In order to prevent the density unevenness, the above-mentioned tolerance is controlled to be a very small value.

There is an image forming apparatus for controlling the above-mentioned tolerance, wherein, after the distribution of the distance between the photosensitive drum and the developing roller in the main scanning direction has been recorded at assembling the process cartridge including drum periphery members such as the photosensitive drum, the developing roller, and so on, the image forming is executed according to the recorded data. In such image forming apparatus, the intensity of the light beam for irradiating the image carrying surface at the developing can be controlled according to the recorded data, that is, it is possible to reduce the intensity of the light beam at the position on which the distance between the photosensitive drum and the developing roller is small, and increase the intensity at a position on which the distance between the photosensitive drum and the developing roller is large.

On the assumption that the developer carrying surface is exactly parallel to the rotatory shaft of the developing roller and there is no variation of the distance between the photosensitive drum and the developing roller after the assembling, the above-mentioned art can prevent the density unevenness.

However, in the developing roller manufactured in real, the developer carrying surface is not exactly parallel to the rotatory shaft of the developing roller and a curve of approximately dozens of μm is generated on the developer carrying surface. When the developing roller rotates, the shaft deviation, the developer carrying surface approaches and separates from the image carrying surface, occurs because of the curve. As a result, the distance between the image carrying surface and the developer carrying surface varies along with the rotation of the photosensitive drum and the rotation of the developing roller.

In addition, the rotation speed of the photosensitive drum is not always identical with the rotation speed of the developing roller, and the circumference of the photosensitive drum is not constant multiples of the circumference of the developing roller. That is to say, even if the position is the same on the photosensitive drum, the distance between the image carrying surface and the developer carrying surface varies whenever the photosensitive drum rotates. When the above-mentioned art is applied to the image forming apparatus wherein the distance between the image carrying surface and the developer carrying surface varies intermittently, it happen to increase the intensity of the light beam regardless of the small distance between the image carrying surface and the developer carrying surface, and reduce the intensity of the light beam regardless of the large distance between the image carrying surface and the developer carrying surface. Therefore, there is a possibility to deteriorate the density unevenness moreover by applying the above-mentioned art to the image forming apparatus.

In order to reduce the density unevenness caused by the shaft deviation, there is an image forming apparatus configured so as to detect the variation of the distance between the image carrying surface and the developer carrying surface as a capacitance, and change a developing AC voltage and a developing DC voltage applied for generating the development field according to the capacitance.

In such image forming apparatus, since the developing AC voltage and the developing DC voltage varies according to the capacitance between the image carrying surface and the developer carrying surface, it is possible to change the intensity of the development field according to the variation of the distance between the image carrying surface and the developer carrying surface. Therefore, as compared with the configuration wherein the developing AC voltage and the developing DC voltage do not vary, it is possible to reduce the density unevenness of the visible image caused by the variation of the distance between the image carrying surface and the developer carrying surface.

It is easy for human sight to recognize the density unevenness at the high printing density rather than the low printing density. For instance, when the variation amounts of the distance between the image carrying surface and the developer carrying surface are the same, the human visual sense recognizes that the density unevenness of the visual image in the 20% density is larger than the density unevenness of the visual image in the solid black of the 100% density. This image forming apparatus is configured so as to reduce an absolute value of a contrast potential by 10% when a detection voltage of capacitance between the image carrying surface and the developer carrying surface raises by 10%, and increase the absolute value of the contrast potential by 10% when the detection voltage of capacitance between the image carrying surface and the developer carrying surface falls by 10%. Therefore, in the image forming apparatus, the visual effect for the human is not taken into consideration at all.

As described above, the rotation speed of the photosensitive drum is not identical with the rotation speed of the developing roller, and the distance between the image carrying surface and the developer carrying surface varies even at the same position on the image carrying surface whenever the photosensitive drum rotates. Since the image forming apparatus is configured that the developing AC voltage and the developing DC voltage are changed according to a mean value of the capacitances between the image carrying surface and the developer carrying surface, the capacitances obtained at plural points dividing the circumference of the photosensitive drum into equal parts, the apparatus cannot deal with those variations.

SUMMARY OF THE INVENTION

The image forming apparatus includes an image carrier, an exposing device, a space detecting unit, a space predicting unit and a correcting unit. The image carrier has an image carrying surface for forming an electric latent image thereon. The exposing device forms an electrostatic latent image on the image carrying surface by irradiating light beam on the image carrying surface. The developer carrier, which is disposed facing to the image carrying surface, has a developer carrying surface for carrying a developer for developing the electrostatic latent image formed on the image carrying surface. The space detecting unit detects a space between the image carrying surface and the developer carrying surface. The space predicting unit predicts, based on the detection result by the space detecting unit, the space between the image carrying surface and the developer carrying surface when an irradiated position on the image carrying surface by the light beam moves and faces to the developer carrier. The correcting unit corrects the intensity of light beam to irradiate by the exposing unit depending on the predicted space between the image carrying surface and the developer carrying surface by the space predicting unit.

In accordance with another aspect of the present discloser, an image forming apparatus includes an image carrier, a developer carrier, an electric field generating unit, a space detecting unit and a correcting unit. The image carrier has an image carrying surface for forming an electric latent image thereon. The developer carrier, which is disposed facing to the image carrying surface, has a developer carrying surface for carrying a developer for developing the electrostatic latent image formed on the image carrying surface. The electric field generating unit generates the development field between the image carrying surface and the developer carrying surface, and the development field for developing the electrostatic latent image formed on the image carrying surface. The space detecting unit detects a space between the image carrying surface and the developer carrying surface. The correcting unit corrects the intensity of the development field based on the space detected by the space detecting unit and a correspondence relation acquired in advance. The correspondence relation is the relation between the image density of a visible image transferred from the image carrying surface to a transferred medium and the intensity of the development field for suppressing the density unevenness of the visible image.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

The embodiments of the present disclosure will be more specifically explained hereinafter with reference to the attached drawings. The present disclosure is materialized by a digital multifunction peripheral.

Figure 1:
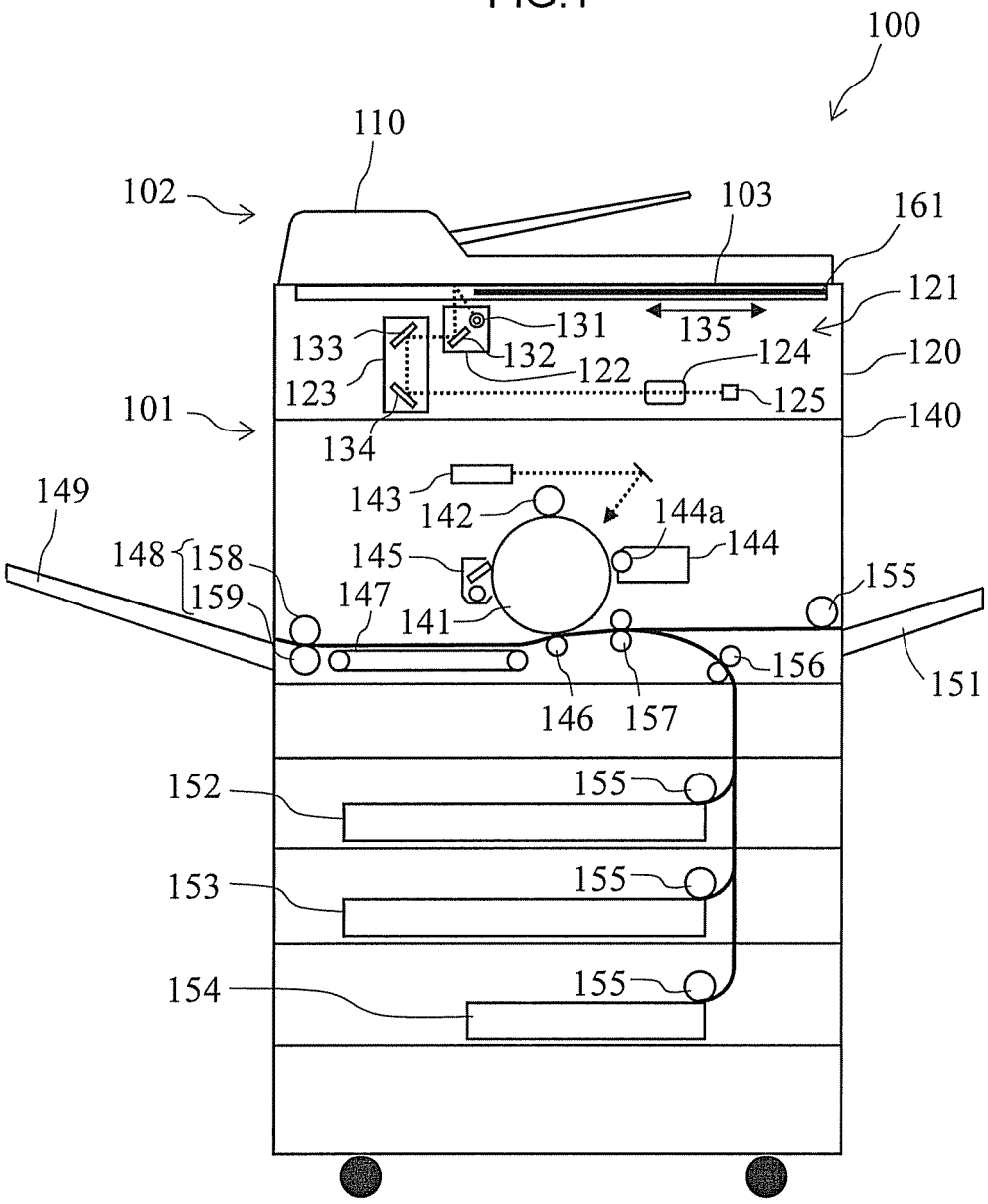
FIG. 1 is a schematic view showing a whole structure of a multifunction peripheral in accordance with an embodiment of the present disclosure.

FIG. 1 is a schematic view showing the whole structure of the digital multifunction peripheral in this embodiment. As shown in FIG. 1, the multifunction peripheral 100 includes a base machine 101 having an image reading unit 120 and an image forming unit 140, and a platen cover 102 placed over the base machine 101. An original plate 103 made of a transparent plate such as a contact glass is arranged on a top surface of the base machine 101. The original plate 103 is opened and closed by the platen cover 102. The platen cover 102 is provided with a document feeder 110. The multifunction peripheral 100 is provided on its front side with an operation panel 161 whereby user can give the multifunction peripheral 100 a copy start instruction and other instructions, and also confirm a status or setting of the multifunction peripheral 100.

The image reading unit 120 is disposed below the original plate 103. The image reading unit 120 reads an image of an original by a scanning optical system 121, and creates digital data (image data) of the image. The original can be placed on the original plate 103 or the document feeder 110. The scanning optical system 121 includes a first carriage 122 and a second carriage 123, and a condenser lens 124. The first carriage 122 is provided with a linear light source 131 and a mirror 132, and the second carriage 123 is provided with mirrors 133 and 134. The light source 131 illuminates the original. The mirrors 132, 133 and 134 guide the light reflected from the original to the condenser lens 124, and the condenser lens 124 forms a light image on a light receiving surface of a line image sensor 125.

In the scanning optical system 121, the first carriage 122 and the second carriage 123 are mounted so as to reciprocate in a sub scanning direction 135. By moving the first carriage 122 and the second carriage 123 in the sub scanning direction 135, the image of the original placed on the original plate 103 can be read by the image sensor 125. In case of reading the image of the original placed on the document feeder 110, the image reading unit 120 temporarily stops the first carriage 122 and the second carriage 123 so as to correspond to an image reading position, and then reads the image of the original passing through the image reading position by the image sensor 125. The image sensor 125 creates the image data of the original from the light image incident on the light receiving surface. The created image data can be printed out on the paper (a transferred medium) by an image forming unit 140. The created image data also can be sent to other devices not show in the drawing from network interface via network.

The image forming unit 140 prints out on papers the image data obtained by the image reading unit 120 or the image data received from the other device connected with the network. The image forming unit 140 has a photosensitive drum 141 as an image carrier. The photosensitive drum 141 rotates at a specific speed in a direction. Around the photosensitive drum 141, a charging device 142, an exposing device 143, a developing device 144 and a cleaning unit 145 are disposed in order from an upstream side in the rotating direction of the photosensitive drum 141. The charging device 142 uniformly electrifies a surface (an image carrying surface) of the photosensitive drum 141. The exposing device 143 irradiates light on the uniformly electrified surface of the photosensitive drum 141 according to the image data, and forms an electrostatic latent image on the photosensitive drum 141. For instance, the exposing device 143 is provided with a laser diode and a polygon mirror as a light source. The light source modulates the intensity of the emitted light beam based on the image data inputted from the outside (image signals). The polygon mirror deflects the light beam emitted from the light source and scans the light beam on the photosensitive drum in the main scanning direction. The developing device 144 adheres the toners, which is the developer, to the latent image, and forms a toner image, which is a visible image, on the photosensitive drum 141. The developing device 144 is provided with a developing roller **144*a* facing to the surface of the photosensitive drum 141 all over the main scanning direction of the photosensitive drum 141. A space is arranged between the developing roller 144*a* and the photosensitive drum 141, and the toner carried by the surface (a developer carrying surface) of the developing roller 144*a* is adhered to the electrostatic latent image by the action of the development field created between the developer carrying surface and the image carrying surface. The cleaning unit 145 removes waste toners remained on the surface of the photosensitive drum 141 from the photosensitive drum 141 after the transferring step, and cleans the surface of the photosensitive drum 141. By the rotation of the photosensitive drum 141**, these processes are performed consecutively.

The image forming unit 140 feeds a paper from a manual paper feed tray 151 or paper feed cassettes 152, 153, or 154 to a transfer unit between the photosensitive drum 141 and a transfer roller 146. The various size of papers can be placed on the manual paper feed tray 151 or be accommodated in the paper feed cassettes 152, 153, or 154. The image forming unit 140 selects the paper specified by user or the paper corresponding to a size of original detected automatically, and then feeds the selected paper from the manual paper feed tray 151 or the paper feed cassettes 152, 153, or 154 through a feed roller 155. The supplied paper is conveyed to the transfer unit by a conveyance roller 156 and a resist roller 157. The paper on which the toner image is transferred is conveyed to a fixing device 148 by a conveyance belt 147. The fixing device 148 has the fixing roller 158 including a heater, and the pressure roller 159, and the toner image is fixed on the paper by the heat and the pressure. The image forming unit 140 ejects the paper passing through the fixing device 148 to a copy receiving tray 149.

It is not limited in particular, but the embodiment in the present disclosure is configured that the electrification amount of the surface of the photosensitive drum 141 on which the exposure light is irradiated is decreased. The developing roller **144*a* for carrying the toner is applied with the electric potential between the electro potential of the non-exposure region of the photosensitive drum 141 on which the light beam is not irradiated, and the electro potential of the exposure region of the photosensitive drum on which the light beam is irradiated. The toner is applied with the electric charge having the same polarity as the charged polarity of the photosensitive drum 141, and the toner is adhered to the exposure region by the electric field generated between the photosensitive drum 141 and the developing roller 144*a*. The transfer roller 146 has been applied with the voltage of the reverse polarity to the polarity of the photosensitive drum 141** (the polarity reverse to the polarity of the toner), and the toner adhered to the exposure region is transferred to the paper.

Figure 2:
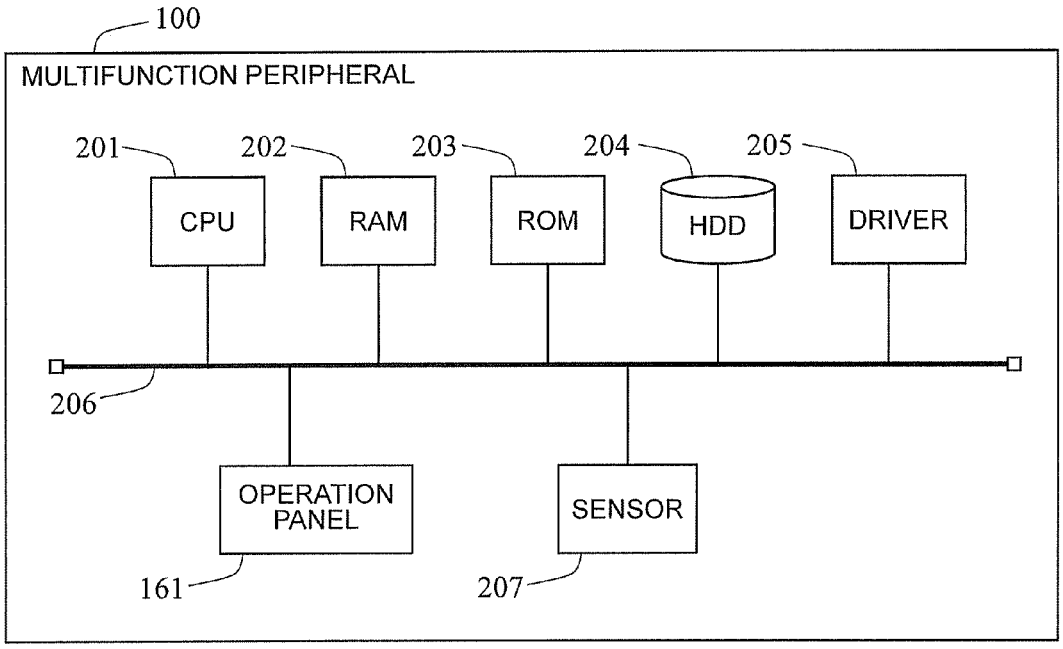
FIG. 2 is a diagram showing a hardware structure of the multifunction peripheral in accordance with an embodiment of the present disclosure.

FIG. 2 is a hardware block diagram of control units for the multifunction peripheral. The multifunction peripheral 100 in this embodiment is connected with CPU (Central Processing Unit) 201, RAM (Random Access Memory) 202, ROM (Read Only Memory) 203, HDD (Hard Disk Drive) 204, and driver 205 corresponding to each driving unit for the document feeder 110, the image reading unit 120, and the image forming unit 140, through internal path 206. ROM 203 and HDD 204 stores control programs, and CPU 201 controls the MFP 100 according to the instructions from the control programs. For instance, CPU 201 uses RAM 202 as a working area, and sends and receives the instruction and the data via driver 205, whereby the operation of each driving unit can be controlled. HDD 204 is used for storing the image data obtained from the image reading unit 120, and the image data received from the other devise via network.

The internal path 206 is also connected with the operation panel 161 and a sensor 207. The operation panel 161 receives the user operation, and supplies a signal based on the operation to CPU 201. The operation panel 161 displays an operation screen on a display according to the control signal from CPU 201. The sensor 207 includes various kinds of sensors, such as an open and shut detecting unit for detecting opening and shutting of the platen cover 102, an original detecting unit for detecting an original on the original plate 103, a temperature detecting unit for detecting the temperature of the fixing unit 148, a detecting sensor for detecting the original or the paper to be conveyed, and so on.

Figure 3:
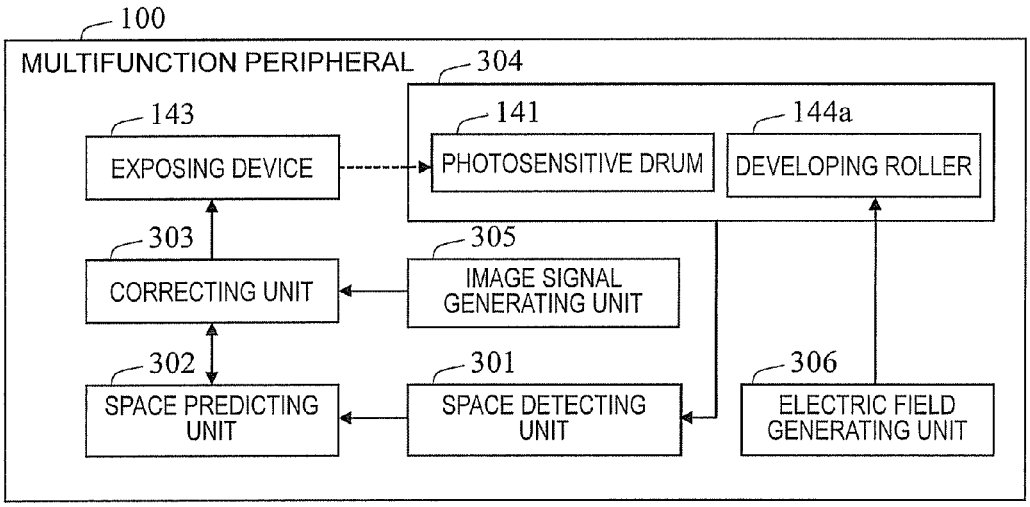
FIG. 3 is a functional block diagram showing the multifunction peripheral in accordance with an embodiment of the present disclosure.

FIG. 3 is a functional block diagram showing a part of the multifunction peripheral that relates to the image forming process in the embodiment. As shown in FIG. 3, the multifunction peripheral 100 has a space detecting unit 301, a space predicting unit 302, and a correcting unit 303. In FIG. 3, the developing roller 144*a* and the photosensitive drum 141, on which an electric field generating unit 306 applies the development field, are shown as an electric field applied object unit 304.

The space detecting unit 301 detects a space between the image carrying surface of the photosensitive drum 141 and the developer carrying surface of the developing roller 144*a*. It is not limited in particular, but in the embodiment, the space detecting unit 301 detects the space between the image carrying surface of the photosensitive drum 141 and the developer carrying surface of the developing roller 144*a* based on a development field generation signal that is applied to the developing roller 144*a* in order to generate the development field.

In the example, the electric field generating unit 306 applies the development field generation signal to the developing roller 144*a*. The electric field generating unit 306 has an AC voltage source for outputting the alternating current signal (alternating-current voltage), and a DC voltage source for outputting the direct current signal (direct-current voltage). The development field generation signal, which is generated by superimposing the AC voltage generated by the AC voltage source on the DC voltage generated by the DC voltage source, is applied to the developing roller 144*a* by the electric field generating unit 306. The DC component in the development field generation signal has a function that moves the toner from the toner carrying surface of the developing roller 144*a* to the exposure region of the image carrying surface on the photosensitive drum 141. The AC component is for allowing the toner to come and go between the developer carrying surface of the developing roller 144*a* and the image carrying surface of the photosensitive drum 141, and has a function for reducing the density unevenness and improving the picture quality as compared with the case using the DC component only.

When the space between the image carrying surface of the photosensitive drum 141 and the developer carrying surface of the developing roller 144*a* is fixed, for example, the AC current at applying the development field generation signal becomes constant. When the space between the image carrying surface of the photosensitive drum 141 and the developer carrying surface of the developing roller 144*a* becomes narrow, the capacitance of the condenser consisting of the image carrying surface and the developer carrying surface gets large. Therefore, the impedance between the image carrying surface and the developer carrying surface becomes small, and the AC current becomes large. Additionally, when the space between the image carrying surface of the photosensitive drum 141 and the developer carrying surface of the developing roller 144*a* becomes wide, the capacitance of the condenser consisting of the image carrying surface and the developer carrying surface gets small. Therefore, the impedance between the image carrying surface and the developer carrying surface becomes large, and the AC current becomes small. Accordingly, the variation of the space between the image carrying surface and the developer carrying surface can be detected as the variation of the AC current at applying the electric field generation signal.

As described above, the developer carrying surface of the developing roller 144*a* is not exactly parallel to the rotatory shaft of the developing roller 144*a*, and the approximately dozens of μm curve appears. On the contrary, since the surface of the photosensitive drum 141 carries the electrostatic latent image and the electrostatic latent image is necessary to be transferred to the transferred medium, the surface of the photosensitive drum 141 is configured to be parallel to the rotatory shaft of the photosensitive drum 141 with very high accuracy. Therefore, when the developing roller 144*a* rotates with the photosensitive drum 141, the space between the image carrying surface and the developer carrying surface varies caused mainly by the shaft deviation (the curve of the surface of the developer carrying surface) at the rotation of the developing roller 144*a*. That is to say, the space between the image carrying surface and the developer carrying surface varies periodically from a state of a narrow space to a state of a wide space, along with the rotation of the developing roller 144*a*.

Figure 4:
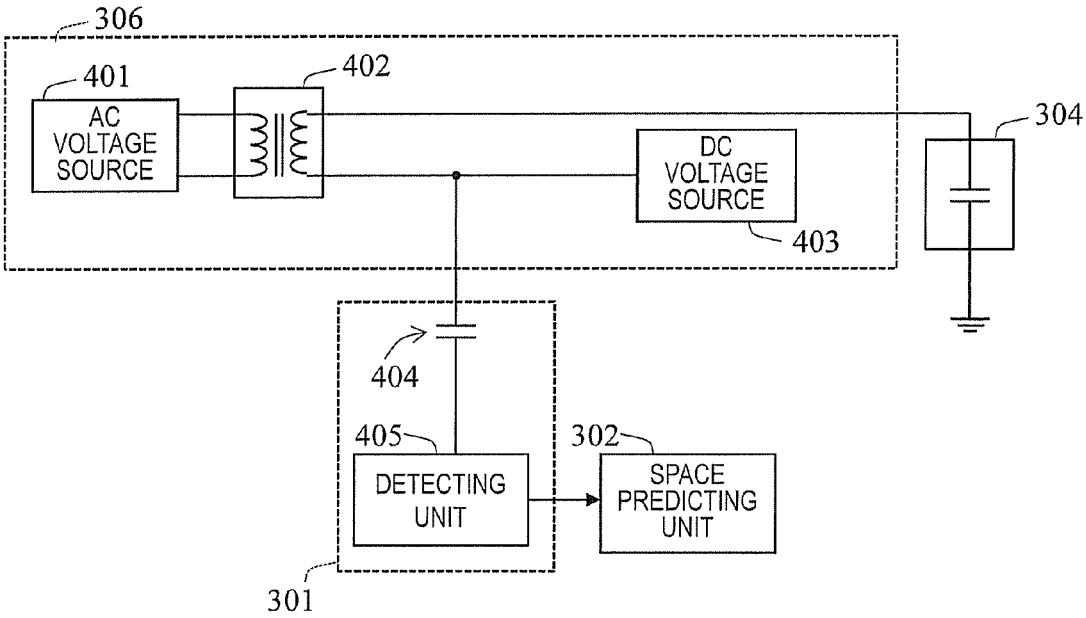
FIG. 4 is a schematic block diagram showing an example of a space detecting unit provided to the multifunction peripheral in accordance with an embodiment of the present disclosure.

FIG. 4 is a diagram showing an example of more definite structure of the space detecting unit 301 and the electric field generating unit 306. In the example, the electric field generating unit 306 includes an AC voltage source 401, a high voltage generating transformer 402, and a DC voltage source 403. The AC voltage source 401 is connected with a primary side of the high voltage generating transformer 402, and one end of a secondary side of the high voltage generating transformer 402 is connected with the electric field applied object unit 304 on which the development field is applied. The other end of the secondary side of the high voltage generating transformer 402 is connected with the DC voltage source 403.

The AC voltage supplied by the AC voltage source 401 is increased by the high voltage generating transformer 402, and then applied on the developing roller 144*a* constituting the electric field applied object unit 304. The DC voltage supplied by the DC voltage source is also applied on the developing roller 144*a*. That is to say, the increased AC voltage superimposed on the DC voltage is applied on the developing roller 144*a*.

The space detecting unit 301 has a condenser 404 for extracting AC current, and a detecting unit 405 for outputting the voltage corresponding to the magnitude of the AC current. In the example, one end of a condenser 404 is connected between the DC voltage source 403 and the high voltage generating transformer 402, and the detecting unit 405 can detect the magnitude of the AC current that flow the secondary side of the high voltage generating transformer 402. The detecting unit 405 has a rectification circuit and a smoothing circuit, for example, and transforms the AC current extracted through the condenser 404 from the current that flow the secondary side of the high voltage generating transformer 402 to the DC current. And then, the detecting unit 405 outputs the voltage corresponding to the magnitude of the DC current to the space predicting unit 302.

Figure 5:
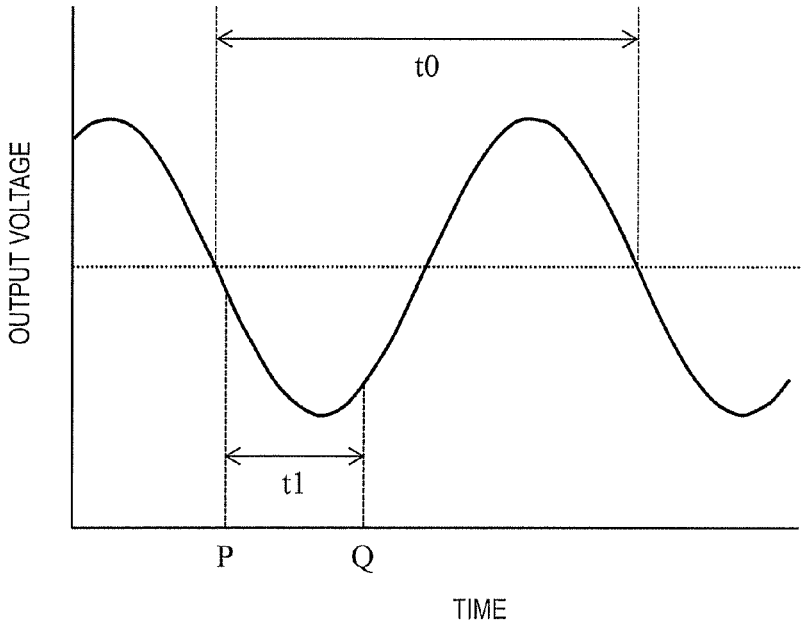
FIG. 5 is a diagram showing an example of the space detection in accordance with an embodiment of the present disclosure.

FIG. 5 is a view schematically illustrating the voltage outputted by the detecting unit 405. In FIG. 5, a horizontal axis corresponds to time, and a vertical axis corresponds to the output voltage. A state that the output voltage is large corresponds to a state that the space between the image carrying surface and the developer carrying surface is narrow, and a state that the output voltage is small corresponds to a state that the space between the image carrying surface and the developer carrying surface is wide.

As shown in FIG. 5, the space between the image carrying surface and the developer carrying surface varies periodically between the narrow space state and the wide space state. In FIG. 5, time t0 corresponding to a cycle is the time for the developer carrying surface to make a rotation along with the rotation of the developing roller 144*a*.

According to the detection result of the space detecting unit 301, the space predicting unit 302 predicts the space between the image carrying surface and the developer carrying surface when the position on the image carrying surface, on which the exposing device 143 irradiates the light beam, moves and faces to the developer carrying surface. In the embodiment, by using that the variation of the space between the image carrying surface and the developer carrying surface become one cycle during the developing roller 144*a* makes one rotation, the space between the image carrying surface and the developer carrying surface is predicted.

Specifically, the space predicting unit 302 predicts the space between the image carrying surface and the developer carrying surface based on the time t0 for the developer carrying surface to make a rotation along with the rotation of the developing roller 144*a* and a moving speed Vd of the image carrying surface.

When the position on the image carrying surface on which the exposing device 143 irradiates the light beam at the startup of the exposing moves and faces to the developing roller 144*a* along with the rotation of the photosensitive drum 141, the moving time is defined as t1. In this case, during the time t1, the developing roller 144*a* makes a (t1/t0) rotation. Accordingly, the space between the image carrying surface and the developer carrying surface is specified when the developing roller 144*a* makes the (t1/t0) rotation from the startup of the exposing, whereby it is possible to predict the space between the image carrying surface and the developer carrying surface when the position on the image carrying surface on which the exposing device 143 irradiates the light beam moves and faces to the developer carrying surface.

In FIG. 5, it is assumed that the developing roller 144*a* is on the time P at startup of the exposing, for example. At this time, when the position on the image carrying surface on which the light beam is irradiated at the startup of the exposing moves and faces to the developing roller 144*a* along with the rotation of the photosensitive drum 141, the developing roller 144*a* is on the time Q that the time t1 passes after the time P, (the state that the developing roller 144*a* makes a (t1/t0) rotation). When the further time t0 passes after the above-mentioned state, the developing roller 144*a* makes one rotation. As a result, the space between the image carrying surface and the developer carrying surface is identical with the space at the time Q. That is to say, when the position on the image carrying surface on which the light beam is irradiated at the startup of the exposing moves and faces to the developing roller 144*a* along with the rotation of the photosensitive drum 141, the space between the image carrying surface and the developer carrying surface is the space at the time Q. After this, whenever the time t0 passes, the space between the image carrying surface and the developer carrying surface is the same as the space between the image carrying surface and the developer carrying surface at the time Q. Therefore, the space between the image carrying surface and the developer carrying surface varies periodically as shown in FIG. 5 for the circumferential distance (t0×Vd) of the image carrying surface irradiated by the light beam.

In this embodiment, the space predicting unit 302 acquires from the space detecting unit 301 information indicating the variation of the space between the image carrying surface and the developer carrying surface as shown in FIG. 5, during the initialization operation that is executed at the recovery from the power-on or the sleep mode (low power mode) to the normal mode, and retains the information. According to the information, the space predicting unit 302 predicts the space between the image carrying surface and the developer carrying surface when the light beam irradiation position at the startup of the exposing moves and faces to the developing roller 144*a* along with the rotation of the photosensitive drum 141. For instance, when the instruction to form the image is inputted, the space predicting unit 302 obtains which stage the developing roller 144*a* is in (e.g. the state at the time P) according to the retained information about the variation of the space between the image carrying surface and the developer carrying surface, based on the voltage inputted from the space detecting unit 301.

In addition, the space predicting unit 302 predicts a periodical variation of the space between the image carrying surface and the developer carrying surface based on the information about the variation of the space between the image carrying surface and the developer carrying surface. As described above, where the circumferential distance (t0×Vd) on the image carrying surface is one round, the space between the image carrying surface and the developer carrying surface varies within the circumferential distance corresponding to one rotation of the developing roller 144*a*. Therefore, the variation of the space between the image carrying surface and the developer carrying surface for one rotation is associated with the circumferential distance (t0×Vd) on the image carrying surface, on that it is possible to predict the space between the image carrying surface and the developer carrying surface when the position on the image carrying surface moves and faces to the developing roller 144*a* along with the rotation of the photosensitive drum 141.

Besides, the time t0 for the developer carrying surface to make one rotation along with the rotation of the developing roller 144*a* and the moving speed Vd of the image carrying surface can be recorded in the space predicting unit 302 in advance. The time t0 and the moving speed Vd may be calculated accordingly at acquiring the information indicating the variation of the space between the image carrying surface and the developer carrying surface.

The space predicting unit 302 inputs to a correcting unit 303 the predicted space between the image carrying surface and the developer carrying surface based on the state of the developing roller 144*a* acquired as described above and the state of the periodical variation of the space between the image carrying surface and the developer carrying surface.

Besides, the space between the image carrying surface and the developer carrying surface does not vary extremely, as long as the photosensitive drum 141 or the developing roller 144*a* is rotated forcibly by the outside force, such as, where the user forcibly draws the paper at the paper jamming on the paper conveyance path. Accordingly, the space predicting unit 302 is not required to acquire the variation of the space between the image carrying surface and the developer carrying surface at any time of the initialization operation. The space predicting unit 302 may be configured to acquire the variation of the space between the image carrying surface and the developer carrying surface when there is an operation for changing the variation state of the space between the image carrying surface and the developer carrying surface.

The correcting unit 303 corrects the intensity of the light beam irradiated by the exposing unit 143 depending on the space between the image carrying surface and the developer carrying surface predicted by the space predicting unit 302. When the space between the image carrying surface of the photosensitive drum 141 and the developer carrying surface of the developing roller 144*a* is narrow, the toner amount to be adhered from the developer carrying surface to the exposure region of the image carrying surface increases, and the density of the toner transferred from the developer carrying surface to the paper of the transferred object is heightened. In order to prevent such increase of the toner, the intensity of the light beam should be reduced when the space between the image carrying surface and the developer carrying surface gets narrow. Hereby, it is possible to suppress the increase of the toner amount to be adhered from the developer carrying surface to the exposure region of the image carrying surface.

On the contrary, when the space between the image carrying surface of the photosensitive drum 141 and the developer carrying surface of the developing roller 144*a* is wide, the intensity of the development field generated between the image carrying surface and the developer carrying surface becomes small. Therefore, the toner amount to be adhered from the developer carrying surface to the exposure region of the image carrying surface is reduced, and the density of the toner to be transferred from the image carrying surface of the photosensitive drum 141 to the paper is lowered. In order to prevent the reduction of the toner amount, the intensity of the light beam should be heightened when the space between the image carrying surface and the developer carrying surface becomes wide. Hereby, it is possible to suppress the reduction of the toner amount to be adhered from the developer carrying surface to the exposure region of the image carrying surface.

In the above-mentioned example, for example, it is assumed that the space predicting unit 302 predicts that the relation between the image carrying surface and the developer carrying surface is identical with the state of the time Q in FIG. 5, when the position to irradiate the light beam on the image carrying surface at the startup of the exposing moves and faces to the developing roller 144*a* along with the rotation of the photosensitive drum 141. At this time, the correcting unit 303 corrects the light beam intensity at the startup of the exposing to the intensity corresponding to the space (voltage) between the image carrying surface and the developer carrying surface at the time Q. After that, the correcting unit 303 heightens or lowers the light beam intensity depending on the periodical variation of the space between the image carrying surface and the developer carrying surface. In this case, the variation (variation range) of the light beam intensity may be determined based on the space (voltage) between the image carrying surface and the developer carrying surface indicated by the information about the variation of the space between the image carrying surface and the developer carrying surface.

After the correction as mentioned above, the exposing is performed by the light beam intensity corresponding to the space between the image carrying surface and the developer carrying surface, so that it is possible to suppress the occurrence of the density unevenness, in particular, in the sub scanning direction.

It is no limited here in particular, but it is configured in the present embodiment that an image signal corresponding to the image data of the printing object, which is generated by an image signal generating unit 305, is inputted to the exposing unit 143 through the correcting unit 303. Specifically, the image signal wherein the light beam intensity is corrected by the correcting unit 303 is inputted to the exposing device 143, and the light beam corresponding to the image signal after the correction is irradiated on the photosensitive drum 141 by the exposing device 143. Here, the image signal is the signal for driving the light source of the exposing device 143 and includes the information specifying the light beam intensity. Besides, the correcting unit 303 may set the correction amount of the light beam intensity in advance, for example, by acquiring a correspondence relation between the light beam intensity and the output voltage by the detecting unit 405 to minimize the brightness dispersion of the visible image at a specific density level.

The space predicting unit 302 and the correcting unit 303 can be realized by an electric circuit or a dedicated calculation circuit. In addition, those units can be realized by hardware including a processor and a memory like RAM or ROM, and software stored in the memory and operated on the processor.

Figure 6:
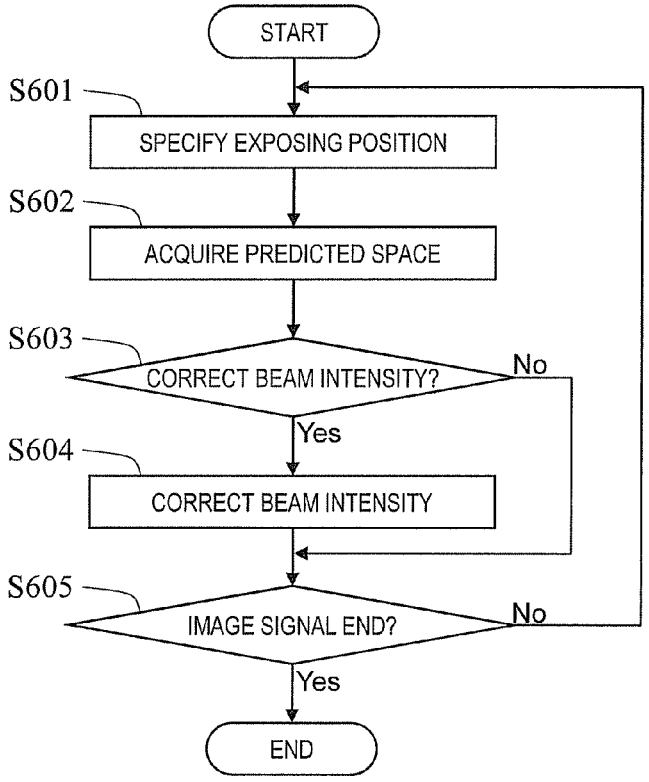
FIG. 6 is a flowchart showing a procedure of a light beam intensity correction executed by the multifunction peripheral in accordance with an embodiment of the present disclosure.

FIG. 6 is a flowchart showing an example of a correction procedure for the light beam intensity executed by the multifunction peripheral 100. The start of the procedure is triggered off by inputting an instruction to form the image in the multifunction peripheral 100. At this time, the image signal generation unit 305 generates the image signal corresponding to the image data. The electric field generating unit 306 applies the electric field generation signal on the electric field applied object unit 304 (the developing roller 144*a*). Hereby, the development field is generated between the developer carrying surface of the developing roller 144*a* and the image carrying surface of the photosensitive drum 141.

At the beginning of the procedure, the correcting unit 303 specifies the exposing position on the image carrying surface of the photosensitive drum 141 in respect with the image signal for one exposure resolution (the irradiation on one point on the image carrying surface) inputted from the image signal generating unit 305 (step S601). Then, the correcting unit 303 inquires of the space predicting unit 302 the predicted space between the image carrying surface and the developer carrying surface, when the exposing position moves and faces to the developing roller 144*a*. In response to the inquiry, the space predicting unit 302 notifies the correcting unit 303 of the space predicted in the above manner (step S602).

Upon receipt of the notice, the correcting unit 303 determines whether or not to correct the light beam intensity (step S603). For instance, the correcting unit 303 determines that no correction is required when the predicted space inputted from the space predicting unit 302 is in a predetermined range (step S603 No). In this case, the correcting unit 303 does not correct the inputted image signal and then inputs it to the exposing unit 143. On the other hand, when the predicted space inputted from the space predicting unit 302 is over the predetermined range, the correcting unit 303 determines that the correction of the light beam intensity is required to correct to the intensity lower than the predetermined intensity. In addition, when the predicted space inputted from the space predicting unit 302 is under the predetermined range, the correcting unit 303 determines that the correction of the light beam intensity is required to correct to the intensity higher than the predetermined intensity (step S603 Yes). In this case, the correction unit 303 corrects the light beam intensity for each inputted image signal according to the above determination, and than inputs it to the exposing device 143 (step S604).

The above steps are executed on all the image signals constituting the image data (step S605 No, S601). When the processing of all the image signals is completed, the procedure is finished (step S605, Yes).

As described above, in the multifunction peripheral 100, no matter how the shaft deviation occurs when the developing roller 144*a* rotates, it is possible to properly adjust the intensity of the light beam for forming the electrostatic latent image on the image carrying surface. As a result, it is possible to suppress the density unevenness of the visible image caused by the variation of the space between the image carrying surface and the developer carrying surface, and improve the picture quality of the entire image.

In addition, in the multifunction peripheral 100, even when the space between the image carrying surface and the developer carrying surface gets different from the assembling state because of the wear of the image carrying surface due to the use, it is possible to properly adjust the intensity of the light beam for forming the electrostatic latent image on the image carrying surface.

Besides, the space detecting unit 301 consists of the electric circuit in the above embodiment as the preferable embodiment, but, it is not limited to such structure. The space detecting unit 301 may detect the space between the image carrying surface of the photosensitive drum 141 and the developer carrying surface of the developing roller 144*a*, and the detecting method is not limited to the electric detecting method, it is possible to employ any arbitrary structure. For instance, it may employ the optical detecting method, or the physical detecting method.

In the above embodiment, the correction amount is defined as three states designated in advance (no correction, the increase of the specific amount of the light beam, and the reduction of the specific amount of the light beam). However, the correction amount of the light beam may be based on the correspondence relation of the density unevenness of the visible image at the specific density level and the space between the image carrying surface and the developer carrying surface, and it may vary stepwisely or smoothly according to the space between the image carrying surface and the developer carrying surface.

The above describes the configuration that the density unevenness of the visible image on the image carrying surface at the position facing to the developer carrying surface is suppressed by adjusting properly the light beam intensity. But, the density unevenness of the visible image on the image carrying surface at the position facing to the developer carrying surface can be suppressed by adjusting the intensity of the development field. The following explains the multifunction peripheral 700 wherein the development field is adjusted. Besides, the schematic structure of the multifunction peripheral 700 is the same as the multifunction peripheral 100 in FIG. 1.

Figure 7:
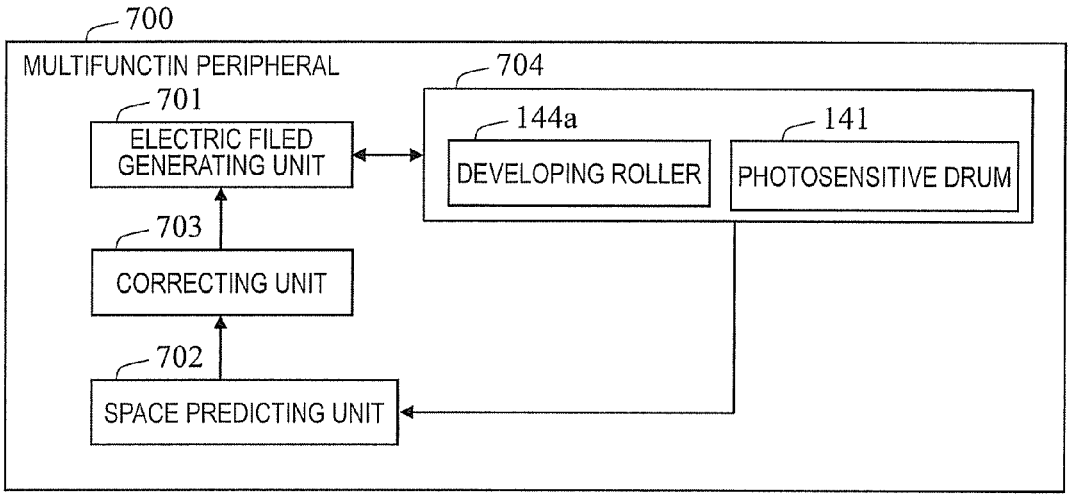
FIG. 7 is a functional block diagram showing the multifunction peripheral in accordance with an embodiment of the present disclosure.

FIG. 7 is a functional block diagram of a part of the multifunction peripheral 700 that relates to the generation of the development field. As shown in FIG. 7, the multifunction peripheral 700 has an electric field generating unit 701, a space detecting unit 702 and a correcting unit 703. Besides, the developing roller 144*a* and the photosensitive drum 141 to which the electric field is applied are illustrated as an electric field applied object unit 704.

The electric field generating unit 701 generates the development field for developing the electrostatic latent image formed on the image carrying surface of the photosensitive drum 141 between the image carrying surface of the photosensitive drum 141 and the developer carrying surface of the developing roller 144*a*. In this embodiment, the electric field generating unit 701 includes the AC voltage source for outputting the alternating-current signal (AC voltage) and the DC voltage source for outputting the direct-current signal (DC voltage), like the above electric field generating unit 306. The electric field generating unit 701 gives the developing roller 144*a* the development field generation signal wherein the AC voltage generated by the AC voltage source is superimposed on the DC voltage generated by DC voltage source. For instance, the DC component can be set about 200V, and the AC component can be set about 1600V at a peak-to-peak.

The space detecting unit 702 detects the space between the image carrying surface of the photosensitive drum and the developer carrying surface of the developing roller 144*a*. It is not limited here in particular; the space detecting unit 702 in the present embodiment detects the space between the image carrying surface of the photosensitive drum 141 and the developer carrying surface of the developing roller 144*a* based on the AC current (the current of the AC component) at applying the development filed generation signal, like the space detecting unit 301.

The correcting unit 703 corrects the intensity of the development field generated by the electric filed generating unit 701 based on the correspondence relation acquired in advance and the detection result detected by the space detecting unit 702. The correspondence relation is the relation between the image density of the visible image transferred on the transferred medium from the image carrying surface and the intensity of the development field for suppressing the density unevenness of the visible image. For instance, when the space between the image carrying surface of the photosensitive drum 141 and the developer carrying surface of the developing roller 144*a* becomes narrow, the intensity of the development filed between the image carrying surface and the developer carrying surface increases. Accordingly, the toner amount adhered from the developer carrying surface to the exposure region of the image carrying surface increases, and the toner density to be transferred from the image carrying surface of the photosensitive drum 141 to the paper as the transferred medium gets higher. In order to prevent the increase of the toner density, when the space between the image carrying surface and the developer carrying surface becomes narrow, the intensity of the development field should be small, namely, the absolute value of the DC component of the development filed generation signal should be small. Hereby, it is possible to prevent the increase of the toner amount to be adhered to the exposure region of the image carrying surface from the developer carrying surface.

On the other hand, when the space between the image carrying surface of the photosensitive drum 141 and the developer carrying surface of the developing roller 144*a* becomes wide, the intensity of the development filed between the image carrying surface and the developer carrying surface becomes small. Therefore, the toner amount adhered from the developer carrying surface to the exposure region of the image carrying surface decreases, and the toner density transferred from the image carrying surface of the photosensitive drum 141 to the paper of the transferred medium gets lower. In order to prevent the reduction of the toner density, the intensity of the development field should be large when the space between the image carrying surface and the developer carrying surface becomes wide. In other words, the absolute value of the DC component of the development filed generation signal may be made large. Hereby, it is possible to prevent the reduction of the toner amount to be adhered to the exposure region of the image carrying surface from the developer carrying surface.

In the present embodiment wherein the variation of the space between the image carrying surface and the developer carrying surface is detected as the variation of the AC current at applying the electric field generation signal, it is configured that the correcting unit 703 makes the absolute value of the DC component of the development field generation signal small when the AC current gets large, and makes the absolute value of the DC component of the development field generation signal large when the AC current gets small.

As described above, it is possible to prevent the density unevenness of the toner density of the visible image on the paper by changing the absolute value of the DC component of the development field generation signal according to the variation of the space between the image carrying surface and the developer carrying surface. However, it is not possible to eliminate the density unevenness completely. For instance, if the spaces between the image carrying surface and the developer carrying surface were the same through the main scanning direction of the image carrying surface and if the absolute value of the DC component of the development field generation signal were analogically changed completely corresponding to the space between the image carrying surface and the developer carrying surface, the density unevenness could be eliminated. But, at any time, the spaces between the image carrying surface and the developer carrying surface are not the same through the main scanning direction of the image carrying surface, and the space between the image carrying surface and the developer carrying surface varies along with the rotation of the photosensitive drum 141 and the developing roller 144*a* when the position in the main scanning direction is different. Accordingly, it is impossible to eliminate the density unevenness perfectly.

It is easy for human sight to recognize the density unevenness at the high printing density rather than the low printing density. When it is assumed that the density of a white image (no toner) is 0% and the density of the solid black image is 100%, it is easy for the human visual sense to recognize the density unevenness of the visible image within the range of 10% to 30% density (not less than the 10% density and not more than the 30% density). According to the experiment by the present inventor, the variation of the absolute value of the DC component of the development field generation signal that is able to highly control the density unevenness of the low density level was not identical with the variation of the absolute value of the DC component of the development field generation signal that is able to highly control the density unevenness of the high density level. Higher the density level, the more the variation of the absolute value of the DC component of the development field generation signal is required to increase.

Here, in the present embodiment, the above correction executed by the correcting unit 703 is configured to correct the intensity of the development field generated by the electric field generating unit 701 to the intensity that is determined according to the space detected by the space detecting unit 702 and the correspondence relation of the image density of the visible image transferred to the transferred medium from the image carrying surface and the intensity of the development field for suppressing the density unevenness of the visible image. That is to say, the intensity of the development field is corrected so as to suppress the unevenness of the visible density according to the image density of the visible image corresponding to the electrostatic latent image. In particular, the correcting unit 703 in the embodiment varies the intensity of the development field generated by the electric filed generating unit 701, according to the space detected by the space detecting unit 702, within the variation range for suppressing the visible density unevenness in the visible image having the 10-30% density in which the visible density unevenness appears remarkably.

Figure 8:
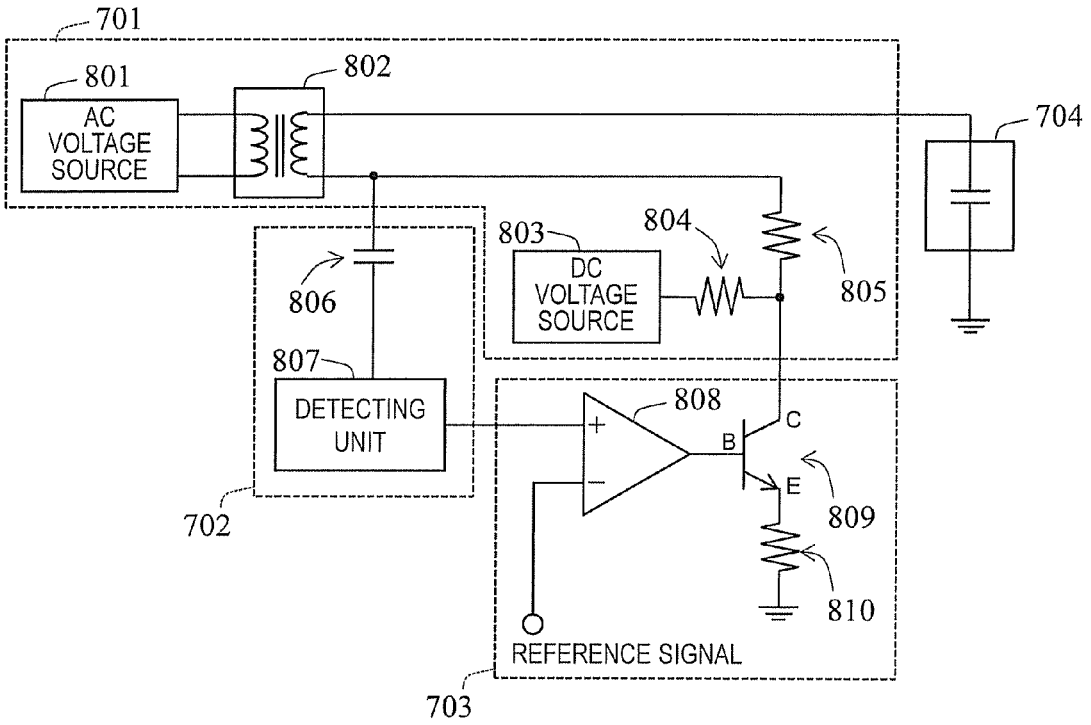
FIG. 8 is a schematic block diagram showing an example of a development field correction structure provided to the multifunction peripheral in accordance with an embodiment of the present disclosure.

FIG. 8 is a diagram showing an example of more definite structure of the electric field generating unit 701, the space detecting unit 702 and the correcting unit 703. In the example, the electric field generating unit 701 includes an AC voltage source 801, a high voltage generating transformer 802, a DC voltage source 803, and a resistor 804 and 805. The AC voltage source 801 is connected with a primary side of the high voltage generating transformer 802, and one end of a secondary side of the high voltage generating transformer 802 is connected with the electric field applied object unit 704 on which the development field is applied. The other end of the secondary side of the high voltage generating transformer 802 is connected with the DC voltage source 803 through the resistor 804 and 805.

The AC voltage supplied by the AC voltage source 801 is increased by the high voltage generating transformer 802, and then applied on the developing roller 144*a* constituting the electric field applied object unit 704. The DC voltage supplied by the DC voltage source is also applied on the developing roller 144*a*. That is to say, the increased AC voltage superimposed on the DC voltage is applied on the developing roller 144*a*.

The space detecting unit 702 has a condenser 806 for extracting the AC current, and a detecting unit 807 for outputting the voltage corresponding to the magnitude of the AC current. In the example, one end of a condenser 806 is connected between the DC voltage source 803 and the high voltage generating transformer 802, and the magnitude of the AC current that flow the secondary side of the high voltage generating transformer 802 can be detected by the detecting unit 807. The detecting unit 807 has a rectification circuit and a smoothing circuit, for example, and converts the AC current extracted by the condenser 806, the AC current that flow the secondary side of the high voltage generating transformer 802, to the DC current. And then, the detecting unit 807 outputs the voltage corresponding to the magnitude of the DC current to the correcting unit 703.

The correcting unit 703 includes a comparison circuit 808 consisting of an operational amplifier and a divided voltage changing unit 809 consisting of a NPN transistor. The output voltage from the detecting unit 807 of the space detecting unit 702 and a reference potential are inputted to the comparison circuit 808. Here, the comparison circuit 808 compares the output voltage of the detecting unit 807 with the reference potential, and outputs High level signal when the output voltage of the detecting unit 807 is larger than the reference potential. When the output value of the detecting unit 807 is lower than the reference potential, the comparison circuit outputs Low level signal. The above-mentioned reference potential is a midpoint potential (E1+E2)/2 of the output potential E1 of the detecting unit 807 when the space between the image carrying surface of the photosensitive drum 141 and the developer carrying surface of the developing roller 144*a* is the smallest, and the output potential E2 of the detecting unit 807 when the space between the image carrying surface of the photosensitive drum 141 and the developer carrying surface of the developing roller 144*a* is the largest.

The NPN transistor constitutes the divided voltage changing unit 809, of which base is connected with an output terminal of the comparison circuit 808. A collector is connected between the resistors 804 and 805. An emitter is grounded through the resistor 810. The divided voltage changing unit 809 is turned ON (a low resistance between the collector and the emitter) and OFF (a high resistance between the collector and the emitter) whether the signal inputted to the base is the High level signal or the Low level signal. When the divided voltage changing unit 809 is tuned OFF, the voltage outputted from the DC voltage source 803 is applied on the developing roller 144*a* without change. On the other hand, when the divided voltage changing unit 809 is turned ON, the voltage is divided depending on a ratio of the resistor 804 and the resistor 805 (strictly speaking, the total resistance of the resistor 810 and the ON resistance between the collector and the emitter), and the divided voltage is applied on the developing roller 144*a* through the resistor 805.

Accordingly, in the structure shown in FIG. 8, it is possible to lower the DC voltage that is applied on the developing roller 144*a* when the AC current flowing the secondary side of the high voltage generating transformer 802 gets large. When the AC current flowing the secondary side of the high voltage generating transformer 802 gets small, it is possible to increase the DC voltage to be applied on the developing roller 144*a*. Besides, the range of the variation of the DC voltage can be adjusted by the setting of the resistance values of the resistor 804 and the resistor 810. Additionally, the resistor 804 and the resistor 805 may be variable resistors.

Figure 9:
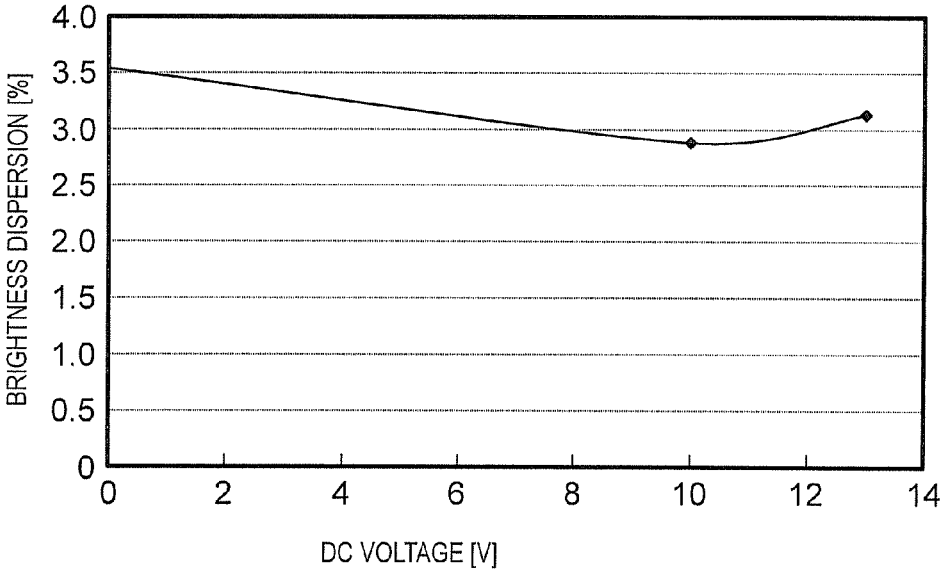
FIG. 9 is a diagram showing an example of a relation of the DC developing voltage and the brightness dispersion in accordance with an embodiment of the present disclosure.

FIG. 9 illustrate a relation of the variation of the DC voltage and the reduction effect of the density unevenness at a specific density level regarding the visible image transferred on the paper. In FIG. 9, the horizontal axis corresponds to the DC voltage that varies by the action of the correcting unit 703, and the vertical axis corresponds to the brightness dispersion that indicates the density unevenness quantitatively. Besides, in this example, the specific density level is evaluated based on the visible image in monochrome (gray) having the 20% density level when white is the 0% density and the solid black is the 100% density. The output voltage of the DC voltage source 803 is 250V. The variation of the space between the image carrying surface of the photosensitive drum 141 and the developer carrying surface of the developing roller 144*a* is up to 20 μm.

As shown in FIG. 9, in the structure that the DC voltage to be applied to the developing roller 144*a* is constant (the variation of the DC voltage=0V) regardless of the variation of the space between the image carrying surface of the photosensitive drum 141 and the developer carrying surface of the developing roller 144*a*, the variation of the brightness dispersion of the visible image on the paper was ±3.5%.

Here is discussed about a case where the conventional art described in the background of the present disclosure is applied to the above-mentioned example. According to the conventional art, in the condition that the detection voltage of capacitance between the developing roller and the photosensitive drum varies within ±10%, the developing DC voltage varies in within ±6.25%. Specifically, the variation of developing DC voltage is in the range of ±0.625% while the variation of the detection voltage of capacitance is in the range of ±1%. In this example, since the variation of the detection voltage of capacitance is in the range of ±4.2% (a measured value), the variation of the DC voltage is 250V×0.042×0.625×2≈13V. Based on this variation of the DC voltage, when the conventional art in the background is applied to the example, the brightness dispersion of the visible image on the paper becomes be in the range of ±3.1%, and it is possible to confirm the effect that the density unevenness is reduced.

On the other hand, in the present disclosure, the variation of the DC voltage is set to 10V in order to most minimize the variation of the brightness dispersion at the density level in this example. When the correction is executed by the correcting unit 703 using the variation of the DC voltage, the variation of the brightness dispersion of the visible image on the paper becomes ±2.9%. As understood from FIG. 9, the variation of the brightness dispersion, which is an index of the density unevenness, is not monotonously reduced for the variation of the DC voltage, but has a minimum value. This is a fact that the inventor has found. By using the variation of the DC voltage at the minimum value, it is possible to reduce the density unevenness further more. In addition, the present disclosure is configured that the minimum value at the specific density within the 10% to 30% density level, at which the density unevenness is easy to be recognized by the human visual sense, is set as the variation of the DC voltage. As a result, it is possible to reduce the density unevenness more than the conventional art.

Besides, the variation of the DC voltage is determined for the respective image forming apparatus on the production line in the factory based on the variation of the space (the variation of the AC current) between the image carrying surface and the developer carrying surface, for example, and the value of the resistors 804 and 810 may be adjusted according to the determined variation of the DC voltage. In addition, the variation of the DC voltage is determined for a specific image forming apparatus, and the value of the resistors 804 and 810 may be adjusted in the same kind of other image forming apparatus based on the determination. The variation of the DC voltage may be determined based on the variation of the brightness dispersion at one density level within the 10% to 30% density level. The variation of the DC voltage is determined respectively based on the variation of the brightness dispersion at plural density levels within the 10% to 30% density level, and by calculating a mean value or a median based on those variations of the DC voltage, the value of the resistors 804 and 810 may be determined.

Figure 10:
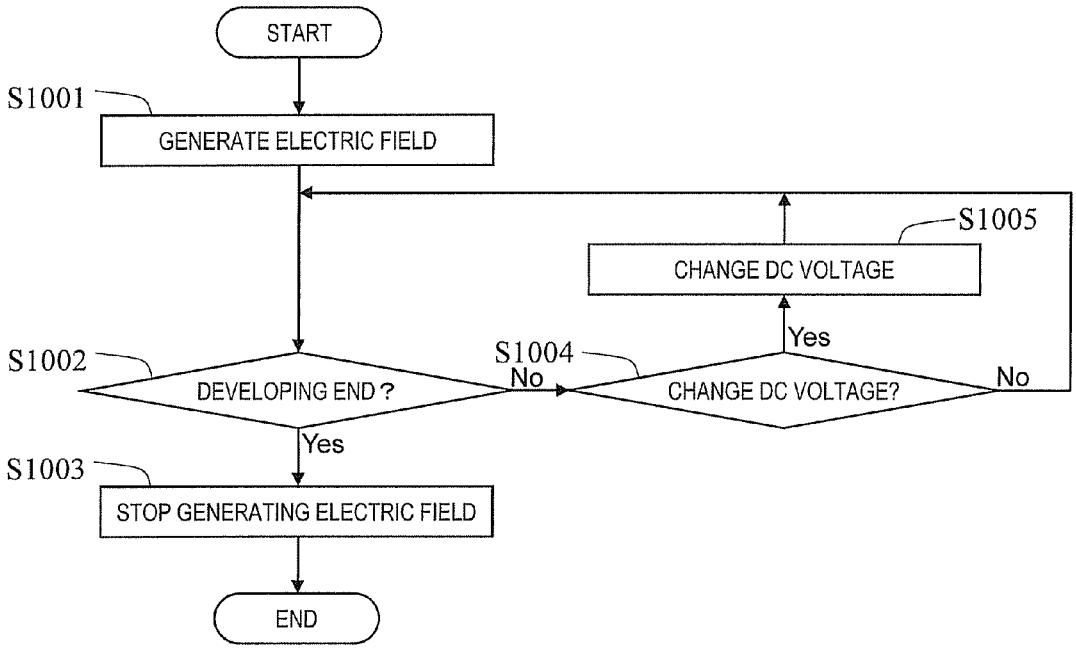
FIG. 10 is a flowchart showing a procedure of the development field correction executed by the multifunction peripheral in accordance with an embodiment of the present disclosure.

FIG. 10 is a flowchart showing an example of the procedure for correcting the development field executed by the multifunction peripheral 700. Besides, the startup of the procedure is triggered off by the input of an instruction for forming the image in the multifunction peripheral 700.

At the beginning of the procedure, the electric field generating unit 701 applies the electric field generation signal to the electric field applied object 704 (the developing roller 144*a*, here). By applying the electric field generation signal thereon, the development field is generated between the developer carrying surface of the developing roller 144*a* and the image carrying surface of the photosensitive drum 141 (step S1001). The electro latent image is created on the image carrying surface of the photosensitive drum 141 by the exposing of the exposing unit 143. In such condition, when the electric latent image reaches the position facing to the developing roller 144*a* along with the rotation of the photosensitive drum 141, the electric latent image is developed (see FIG. 1).

When the electric field generating unit 701 creates the development field between the developer carrying surface and the image carrying surface, the space detecting unit 702 monitors the space between the developer carrying surface and the image carrying surface (step S1002, NO, S1004). As described above, in the present embodiment, the space detecting unit 702 monitors the space between the developer carrying surface and the image carrying surface according to the AC current of the electric field generation signal, and then inputs a signal to the correcting unit 703. The inputted signal is decided based on a case where the AC current is higher than a predetermined current or a case where the AC current is lower than the predetermined current. Besides, for convenience, the signal for turning on the divided voltage changing unit 809 of the correcting unit 703 (the high level signal) is defined as a low DC voltage signal, and the signal for turning off the divided voltage changing unit 809 of the correcting unit 703 (the low level signal) is defined as a high DC voltage signal.

For instance, when the development field between the developer carrying surface and the image carrying surface is generated by the electric field generating unit 701, if the AC current of the electric field generation signal is lower than the predetermined current, the space detecting unit 702 inputs the high DC voltage signal to the correcting unit 703 (step S1004 No). In this case, the divided voltage changing unit 809 is turned off, and the DC voltage outputted from the DC voltage source 803 is applied to the developing roller 144*a* without change. After this, the condition is maintained while the AC current of the electric field generation signal is the predetermined current or less (step S1002 No, S1004 No).

During the developing, when the AC current of the electric field generation signal becomes larger than the predetermined current along with the rotation of the photosensitive drum 141 and the rotation of the developing roller 144*a*, the space detecting unit 702 inputs the low DC voltage signal to the correcting unit 703 (step S1002 No, S1004 Yes). At this time, the divided voltage changing unit 809 turns on, and the DC voltage outputted by the DC voltage source 803 is divided by the resistors 804 and 810 in the correcting unit 703 and be lowered to a lower DC voltage, which is applied on the developing roller 144*a* (step S1005). This condition is maintained while the AC current of the electric field generation signal is the predetermined current or more (step S1002 No, S1004 Yes).

After that, when the AC current of the electric field generation signal becomes the predetermined current or less along with the rotation of the photosensitive drum 141 and the rotation of the developing roller 144*a* during the developing, the space detecting unit 702 inputs the high DC voltage signal to the correcting unit 703 (step S1002 No, S1004 Yes). At this time, the divided voltage changing unit 809 turns off, and the DC voltage outputted from the DC voltage source 803 is applied to the developing roller 144*a* without change. The condition is maintained while the AC current of the electric field generation signal is the predetermined current or less (step S1002 No, S1004 No).

The above-mentioned steps are executed continuously by the end of the developing. When the developing ends, the electric field generating unit 701 stops generating the development electric field and the procedure is terminated (step S1002 Yes, S1003). Besides, when development field is generated between developer carrying surface and the image carrying surface by the electric field generating unit 701, if the AC current of the electric field generation signal is larger than the predetermined current, the space detecting unit 702 inputs the low DC voltage signal to the correcting unit 703. The steps following that are described as above.

As described above, in the multifunction peripheral 700, the intensity of the development filed can be corrected according to the variation of the space between the image carrying surface and the developer carrying surface, and it is possible to optimize the intensity that is determined corresponding to the image density of the visible image to be formed. As a result, it is possible to suppress the unevenness of the visual density of the visible image and improve the picture quality of the whole image.

In particular, by noticing that the density unevenness that the human being can easily recognize by his visual sense is within the specific range of the density level, it is configured in this multifunction peripheral 700 to set the range of the variation of the DC voltage that can reliably suppress the density unevenness in the specific range of the density level of the visible image. Therefore, it is possible to suppress the density unevenness visually recognized more than the conventional arts.

In addition, in the multifunction peripheral 700, it is configured that the DC voltage to be applied on the developing roller 144*a* switches within the predetermined range of the variation of the DC voltage according to the variation of the space between the image carrying surface of the photosensitive drum and the developer carrying surface of the developing roller 144*a*. Therefore, if the rotation speed of the photosensitive drum 141 is different from the rotation speed of the developing roller 144*a*, it is possible to apply on the developing roller 144*a* with the appropriate DC voltage according to the space between the image carrying surface of the photosensitive drum and the developer carrying surface of the developing surface 144*a*.

Besides, the above-mentioned embodiments do not limit the technical range of the present disclosure, and in addition to the foregoing description, any kind of modification or application is available. For instance, as the most preferable embodiment in the above embodiments, the space detecting unit 702 and the correcting unit 703 are materialized by the electric circuits, but the configuration is not limited to this. The space detecting unit 702 may detect the space between the image carrying surface of the photosensitive drum 141 and the developer carrying surface of the developing roller 144*a*. It is not limited to the electric detecting method, but any arbitrary configuration can be employed. For instance, it may employ the optical detecting method or the physical detecting method. The correcting unit 703 may vary the DC voltage to be applied on the electric field applied object 704 within the predetermined variation range of the DC voltage. It is not limited to the correction method by the electric circuit, but any arbitrary configuration can be employed. For instance, the DC voltage source is composed of a variable voltage source, and the correction unit 703 can be configured as a control unit for controlling the output voltage of the DC voltage source 803. Such correction unit 703 can be materialized by a dedicated calculation circuit, a hardware provided With a processor and a memory like ROM or RAM, or a software stored in the memory and working on the processor.

In the above embodiments, the DC voltage to be applied on the developing roller is set as two states having the predetermined variation range of the DC voltage. However, the DC voltage to be applied on the developing roller 144*a* may be based on the relation between the image density of the visible image transferred to the transferred medium from the image carrying surface and the intensity of the development field for suppressing the density unevenness of the visible image. Accordingly, the DC voltage may be configured to vary stepwisely or smoothly according to the space between the image carrying surface and the developer carrying surface.

Moreover, the above embodiments described the configuration that, nevertheless that the visible image corresponding to the electrostatic latent image includes pixels in the range of the 10% to 30% density or not, the intensity of the development field is corrected according to the variation of the DC voltage for suppressing the density unevenness in the range of the 10% to 30% density. However, it may be configured that the DC voltage varies according to the density dispersion included in the visible image corresponding to the electrostatic latent image. For instance, where the visible image corresponding to the electrostatic latent image does not include any pixel in the range of the 10% to 30% density but includes only the pixels in the range of the 50% to 90% density, the correcting unit 703 may correct the intensity of the development field according to the variation of the DC voltage found for the predetermined 70% density in the above-mentioned manner. Moreover, the correction unit 703 may correct the intensity of the development field depending on the variation of the DC voltage found for the predetermined density (or the density nearest to the predetermined density) that is the highest occupancy in the visible image corresponding to the electrostatic latent image by means of the above-mentioned method. Such configuration can be materialized by the variable resistors 804 and 810. In such configuration, the resistance value of the resistors 804 and 810 may change, according to the density of the pixels included in the visible image, to the intensity predetermined based on the relation of the image density of the visible image transferred to the transferred medium from the image carrying surface and the intensity of the development field for suppressing the density unevenness on the visible image. Besides, the density information included in the visible image corresponding to the electrostatic latent image can be acquired easily based on the image data to be formed.

Figure 11:
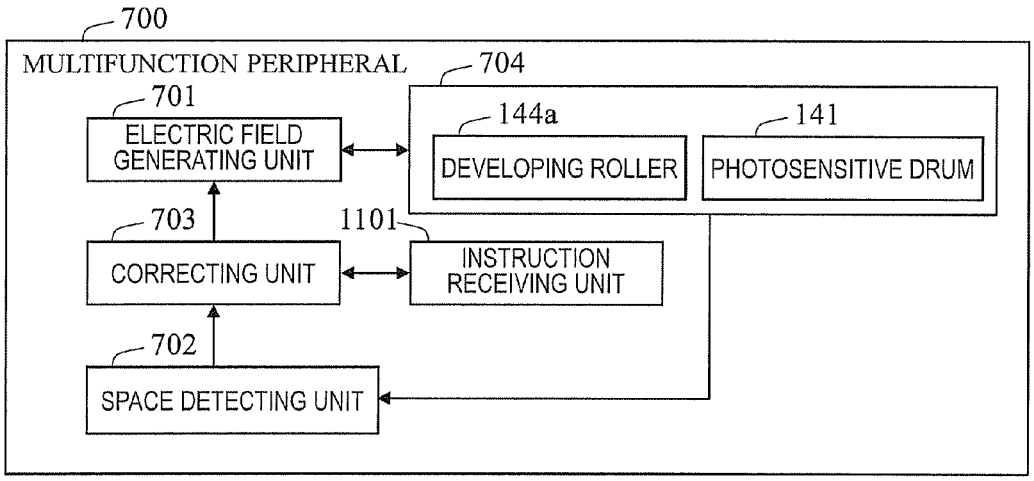
FIG. 11 is a functional block diagram showing the multifunction peripheral in accordance with an embodiment of the present disclosure.

In the above configuration, the correcting unit 703 automatically selects the density range for suppressing the density unevenness based on the density dispersion included in the visible image corresponding to the electrostatic latent image. But the density range for suppressing the density unevenness may be selected by user. Such configuration can be materialized by providing the multifunction peripheral 700 with an instruction receiving unit 1101 as shown in FIG. 11, for example. In the configuration, the instruction receiving unit 1101 receives the instruction of the density range for suppressing the density unevenness selected by the user. The user can input the instruction to the instruction receiving unit 1101 from an operation panel 161, for example. Otherwise, the user can input the instruction to the instruction receiving unit 1101 through an other device like information processing terminal connected with the multifunction peripheral via network (not shown in the drawing).

One example is discussed hereinafter about a case where the visible image corresponding to the electrostatic latent image includes both a range wherein the image density is low (e.g. the 10% to 30% density) and a range wherein the image density is higher than the low density range (e.g. the 30% and more density). In this case, the instruction receiving unit 1101 may be configured to receive the user's instruction whether the correcting unit corrects the intensity of the development field corresponding to the low density range or the high density range.

According to the above configuration, it is possible to control the density unevenness for the visible image corresponding to the electrostatic latent image including the high density range and the low density range in the same ratio, according to the user's preference. The number of divisions for the density range that the user can select is not limited to the above-mentioned two divisions. The number of divisions may be three and more.

In the above embodiments, there is described about the multifunction peripheral for the single color printing, but instead of the single color printing machine, the multifunction peripheral for the multicolor (full color) printing may be used. In such case, the above-mentioned operation may be executed on the developing roller for each color. In the flowcharts shown in FIG. 6 and FIG. 10, the order of each step can be changed properly as long as it is possible to provide with the equivalent effect. In the above embodiments, there is described about the configuration that the DC voltage and AC voltage for generating the developing field are applied to the developing roller 144*a*. As the configuration for applying the DC voltage and the AC voltage, any configuration may be used.

Additionally, in the above embodiments, the present disclosure is materialized as the digital multifunction peripheral. Except for the digital multifunction peripheral, the present disclosure can be applied to any image forming apparatus such as the printer, or the copying machine.

According to the present disclosure, it is possible to control the density unevenness of the visible image on the image carrying surface facing to the developer carrying surface. Therefore, it is possible to suppress more effectively the density unevenness of the visible image caused by the variation of the space between the image carrying surface and the developer carrying surface as compared with the conventional arts. The present disclosure is very useful as the image forming apparatus and the image forming method.

Besides, the specification of the present disclosure also discloses the image forming method for forming the electrostatic latent image on the image carrying surface by irradiating the light beam on the image carrying surface of the image carrier, and developing the electrostatic latent image formed on the image carrying surface by the developer carried by the developer carrying surface of the developer carrier facing to the image carrying surface. In this image forming method, the first step is for acquiring the information indicating the variation of the space between the image carrying surface and the developer carrying surface. Then, the next step is for predicting the space between the image carrying surface and the developer carrying surface when the irradiation position of the light beam on the image carrying surface moves and faces to the developer carrying surface, according to the information indicating the variation of the space between the image carrying surface and the developer carrying surface. Based on the predicted space between image carrying surface and the developer carrying surface, the intensity of the light beam to irradiate the image carrying surface is corrected.

In the image forming method, it may be configured that the space between the image carrying surface and the developer carrying surface is predicted based on the time for making one rotation of the developer carrying surface along with the rotation of the developer carrier and the moving speed of the image carrying surface.

The present specification discloses the image forming method for generating the development field between the image carrying surface of the image carrier and the developer carrying surface of the developer carrier, and then developing the electrostatic latent image formed on the image carrying surface by the developer carried by the developer carrying surface. In this image forming method, the first step is for acquiring the correspondence relation between the image density of the visible image transferred from the image carrying surface to the transferred medium and the intensity of the development field for suppressing the density unevenness of the visible image. When the electrostatic latent image formed on the image carrying surface is developed, the intensity of the development is corrected based on the above correspondence relation and the space between the image carrying surface and the developer carrying surface.

In the image forming method, when the visible image corresponding to the electrostatic latent image is included in the range of the 10% to 30% image density, it can be configured that the intensity of the development field is corrected corresponding to the 10% to 30% density range. In the configuration, when the visible image to be formed includes pixels having many kinds of image density, the development field is corrected to the optimum intensity of the electric field for the range of 10% to 30% image density wherein the density unevenness is easily recognized visually. Therefore, it is possible to suppress the density unevenness of the visible image to be formed, in the density range wherein the density unevenness is easy to be recognized visually.

In addition, it is possible to employ the configuration, when the visible image corresponding to the electrostatic latent image includes the range that the image density is low and the range that image density is higher than the low density range, that a unit receives the instruction that the user selects whether the intensity of the development field is corrected corresponding to the low density range or the high density range. Under such configuration, it is possible to control the density unevenness for the visible image corresponding to the electrostatic latent image including the high density range and the low density range in the same ratio, according to the user's preference.

What is claimed is:

1. An image forming apparatus comprising:

an image carrier having an image carrying surface for forming an electric latent image thereon;

a developer carrier being disposed facing to the image carrying surface, and having a developer carrying surface for carrying a developer for developing the electrostatic latent image formed on the image carrying surface;

an electric field generating unit for generating the development field between the image carrying surface and the developer carrying surface, the development field developing the electrostatic latent image;

a space detecting unit for detecting a space between the image carrying surface and the developer carrying surface;

a correcting unit for correcting the intensity of the development field based on the space detected by the space detecting unit and the correspondence relation between the image density of a visible image transferred from the image carrying surface to a transferred medium and the intensity of the development field for suppressing the density unevenness of the visible image;

wherein, when the visible image corresponding to the electrostatic latent image includes both a low density range in which the density unevenness of the visible image appears remarkably and a density range higher than the low density range, an instruction receiving unit receives an instruction from a user to the correcting unit to correct the intensity of the development field corresponding to the low image density range or the high density range.

2. The image forming apparatus according to claim 1, wherein the correcting unit corrects the intensity of the development field corresponding to the 10% to 30% density range when the visible image corresponding to the electrostatic latent image includes a range of the 10% to 30% image density.

3. The image forming apparatus according to claim 2, wherein the correcting unit corrects the intensity of the development field by varying a DC voltage of the development field outputted by the electric field generating unit.

4. The image forming apparatus according to claim 1, wherein the correcting unit corrects the intensity of the development field by varying a DC voltage of the development field outputted by the electric field generating unit.

5. An image forming method for generating a development field between an image carrying surface of an image carrier and a developer carrying surface of a developer carrier, and developing an electrostatic latent image formed on the image carrying surface by a developer carried by the developer carrying surface, the method comprising acquiring a correspondence relation between an image density of a visible image transferred from the image carrying surface to a transferred medium and an intensity of the development field for suppressing the density unevenness of the visible image; and correcting the intensity of the development field at developing the electrostatic latent image formed on the image carrying surface, based on a space between the image carrying surface and the developer carrying surface and the acquired correspondence relation;

wherein, when the visible image corresponding to the electrostatic latent image includes both a low image density range in which the density unevenness of the visible image appears remarkably and an image density range higher than the low image density range, the method further comprises receiving a user instruction whether to correct the intensity of the development field corresponding to the low image density range or the high density range.

6. The image forming method according to claim 5, wherein the intensity of the development field is corrected corresponding to the 10% to 30% density range when the visible image corresponding to the electrostatic latent image includes a range of the 10% to 30% image density.

7. The image forming method according to claim 6, wherein the intensity of the development field is corrected by varying a DC voltage for generating the development field.

8. The image forming method according to claim 5, wherein the intensity of the development field is corrected by varying a DC voltage for generating the development field.

* * * * *